US006186830B1

(12) United States Patent
Lin et al.

(10) Patent No.: US 6,186,830 B1
(45) Date of Patent: Feb. 13, 2001

(54) SHIELDED ELECTRICAL RECEPTACLE CONNECTOR

(75) Inventors: Jih-Luen Lin; Sheng-Ho Yang, both of Taipei Hsien (TW)

(73) Assignee: Advanced Connecteck Inc., Hsintein (TW)

( * ) Notice: Under 35 U.S.C. 154(b), the term of this patent shall be extended for 0 days.

(21) Appl. No.: 09/429,866

(22) Filed: Oct. 29, 1999

(51) Int. Cl.[7] ..... H01R 13/648
(52) U.S. Cl. ..... 439/607; 439/79
(58) Field of Search ..... 439/607, 608, 439/609, 79, 610, 567

(56) References Cited

U.S. PATENT DOCUMENTS 6,095,837 * 8/2000 David et al. ..... 439/188
6,099,349 * 8/2000 Boutros ..... 439/541.5
6,109,966 * 8/2000 Chiou ..... 439/607
6,120,323 * 9/2000 Zhung et al. ..... 439/567

* cited by examiner

*Primary Examiner*—Khiem Nguyen
(74) *Attorney, Agent, or Firm*—Merchant & Gould P.C.

(57) ABSTRACT

A shielded receptacle connector includes a dielectric terminal mounting seat having a terminal aligning portion for mounting solder tail portions of a plurality of contact terminals and a mating portion for mounting contact portions of the contact terminals. The terminal aligning portion has a proximate end face and a distal end face relative to the mating portion, a pair of lateral walls extending between the proximate and distal end faces and opposite to each other in a transverse direction, and a pair of tongue engaging groove units formed in the lateral walls respectively and extending from the proximate end face towards the distal end face and crossing over at least one of the solder tail portions. A metal shield includes a first tubular portion enclosing and cooperating with the mating portion to define an annular receiving space therebetween, and a second tubular portion having two side walls, and two engaging tongues formed by punching and bending lowermost portions of the side walls such that the engaging tongues extend toward each other to engage the tongue engaging groove units of the lateral walls, respectively, so as to prevent the lowermost portions of the side walls of the second tubular portion from being thrust away relative to the terminal aligning portion.

9 Claims, 8 Drawing Sheets

PRIORT ART

SHIELDED ELECTRICAL RECEPTACLE CONNECTOR

BACKGROUND OF THE INVENTION

1. Field of the Invention

The invention relates to an electrical connector, more particularly to a shielded surface-mount electrical receptacle connector of the universal serial bus (USB) connector-type for use in the computer field.

2. Description of the Related Art

Referring to FIGS. 1, 2 and 3, a conventional shielded surface-mount electrical receptacle connector of the universal serial bus (USB) connector-type adapted to be mounted on a circuit board and is adapted to mate with a shielded electrical plug connector, said connector includes a plurality of contact terminals 110, a dielectric terminal mounting seat 11, a metal shield 13, and a metal cap 14.

As illustrated, each of the contact terminals 110 has a contact portion 110C that extends in a longitudinal direction, and a solder tail portion 110S that extends from the contact portion in a first transverse direction relative to the longitudinal direction.

The terminal mounting seat 11 includes a mating portion 113 for mounting the contact portions 110C thereon, and a terminal aligning portion 111 which has two opposite side walls 111W extending in the first transverse direction and spaced from each other a second direction transverse to the first transverse direction to form a pair of lowermost portions, and a pair of positioning parts 111C that extend toward each other in the second direction to define a terminal aligning slit therebetween. The solder tail portions 110S of the contact terminals 110 pass through the terminal aligning slit and are adapted to be in electrical contact with the circuit board (not shown).

The metal shield 13 is disposed to shield the contact portions 110C and the solder tail portion 110S from electromagnetic interference (EMI) in the second direction. The metal shield 13 includes a tubular shell 130 with first and second open ends 131,132 which are opposite to each other in the longitudinal direction. The tubular shell 130 has a rear portion 130R that encloses the terminal aligning portion 11, and a front portion 130F that encloses and co-operates with the mating portion 113 to define an annular receiving space 13A therebetween (see FIG. 2) which is adapted to accommodate a shielded electrical plug connector (not shown) when the latter is inserted thereinto via the first open end 131. The rear portion 130R extends integrally from and in alignment with the front portion 130F, and has at least one pair of side walls 135 that extend in the first transverse direction and that are spaced apart from each other in the second transverse direction to form a pair of lowermost portions with bendable portions 134 that are spaced apart from each other in the second transverse direction, and a pair of engaging groove units each being formed by punching and bending a respective one of the bendable portions 134 such that the engaging groove units permit extension of and confine front ends 112 of the positioning parts 111C to prevent them from being thrust away from the terminal mounting seat 2.

A disadvantage of the aforesaid electrical receptacle connector resides in that, the side walls 135 of the rear portion 130R in the tubular shell 130 are susceptible to thrust in the longitudinal direction during transportation. The side walls 135 are thus disposed in a state of being expandible outwardly and laterally relative to the terminal mounting seat 2, and may result in deformation of the shielded electrical receptacle connector.

SUMMARY OF THE INVENTION

Therefore, the object of this invention is to provide an electrical receptacle connector of universal serial bus (USB) connector-type which includes an EMI metal shield that is free of the aforesaid disadvantage that generally results during transport of the conventional shielded electrical surface-mount connector.

Accordingly, a shielded surface-mount electrical receptacle connector according to the present invention is adapted to be mounted on a circuit board and is adapted to mate with a shielded electrical plug connector, and includes a plurality of contact terminals, a dielectric terminal mounting seat, and a metal shield. Each of the contact terminals has a contact portion extending in a longitudinal direction, and a solder tail portion extending from the contact portion in a first direction transverse to the longitudinal direction. The terminal mounting seat includes a mating portion for mounting the contact portions thereon and a terminal aligning portion which has upper and lower major mounting surfaces opposite to each other in the first transverse direction. The solder tail portions of the contact terminals pass through the upper and lower major mounting surfaces and are adapted to be in electrical contact with the circuit board. The terminal aligning portion further has a proximate end face and a distal end face relative to the mating portion, a pair of lateral walls extending between the proximate and distal end faces and opposite to each other in a second direction transverse to the first transverse direction, and a pair of tongue engaging groove units formed in the lateral walls, respectively, and extending from the proximate end face towards the distal end face and crossing over at least one of the solder tail portions. The metal shield is disposed to shield the contact portions and the solder tail portions from electromagnetic interference in the second transverse direction. The metal shield includes a tubular shell with first and second open ends opposite to each other in the longitudinal direction. The tubular shell includes a first tubular portion enclosing and cooperating with the mating portion to define an annular receiving space therebetween that is adapted to accommodate the shielded electrical plug connector when the latter is inserted thereinto via the first open end, and second tubular portion that extends integrally from and in alignment with the first tubular portion and that encloses the terminal aligning portion. The second tubular portion has at least one pair of opposite side walls spaced apart from each other in the second transverse direction and extending in the first transverse direction to form a pair of spaced apart lowermost portions facing the lateral walls, respectively, at least two pairs of mounting legs each pair being spaced apart from each other in the longitudinal direction by a bendable portion with a length corresponding to a respective one of the tongue engaging groove units and extending in the first transverse direction from the lowermost portions of the side walls. The mounting legs are adapted to be inserted into the circuit board. Each of the two engaging tongues is formed by punching and bending the bendable portion of a respective one of the lowermost portions of the side walls such that the engaging tongues extend toward each other in the second transverse direction to engage the tongue engaging groove units of the lateral walls, respectively, so as to prevent the lowermost portions of the side walls of the second tubular portion from being undesirably thrust away from the terminal aligning portion.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
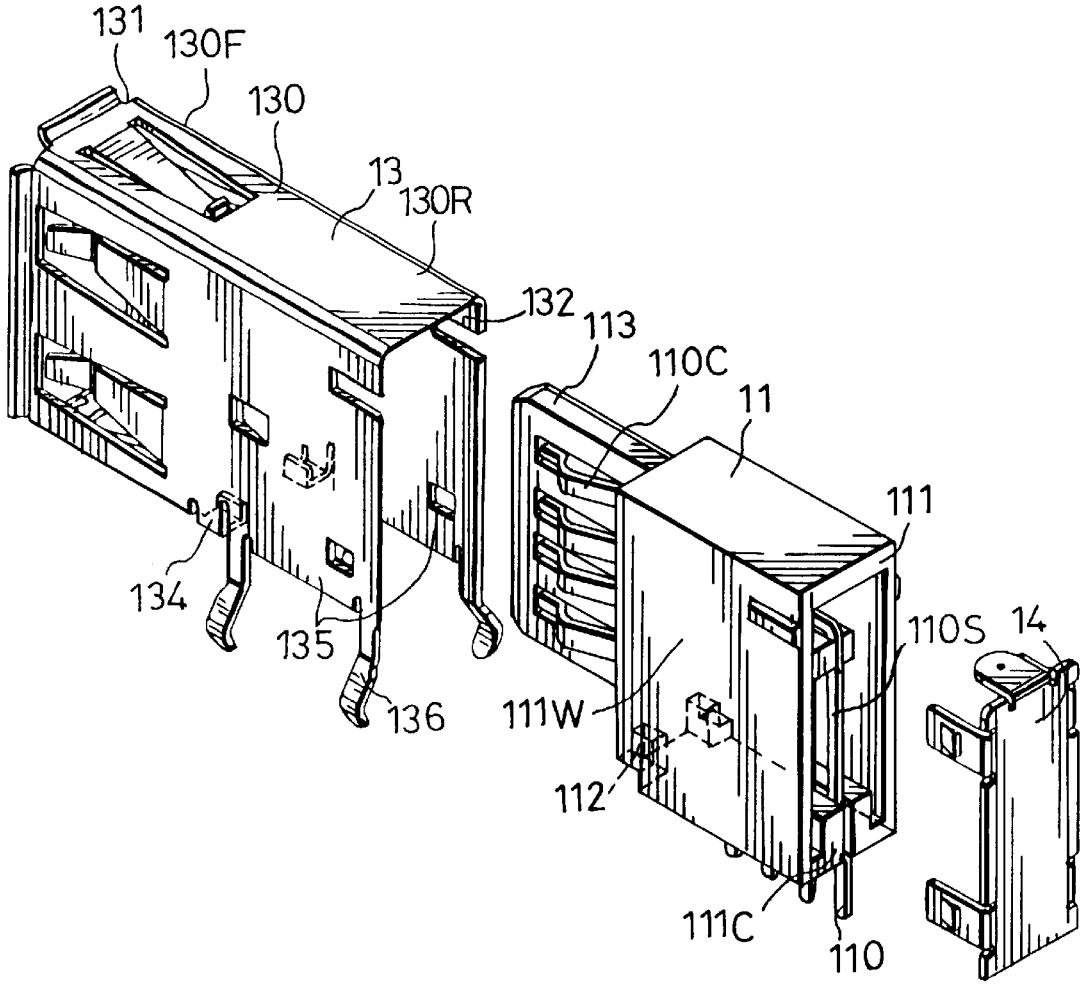
FIG.1 PRIOR ART
FIG. 1 is an exploded view of a conventional electrical surface-mount receptacle connector of the universal serial bus connector-type and adapted to be mounted on a circuit board.
Figure 2:
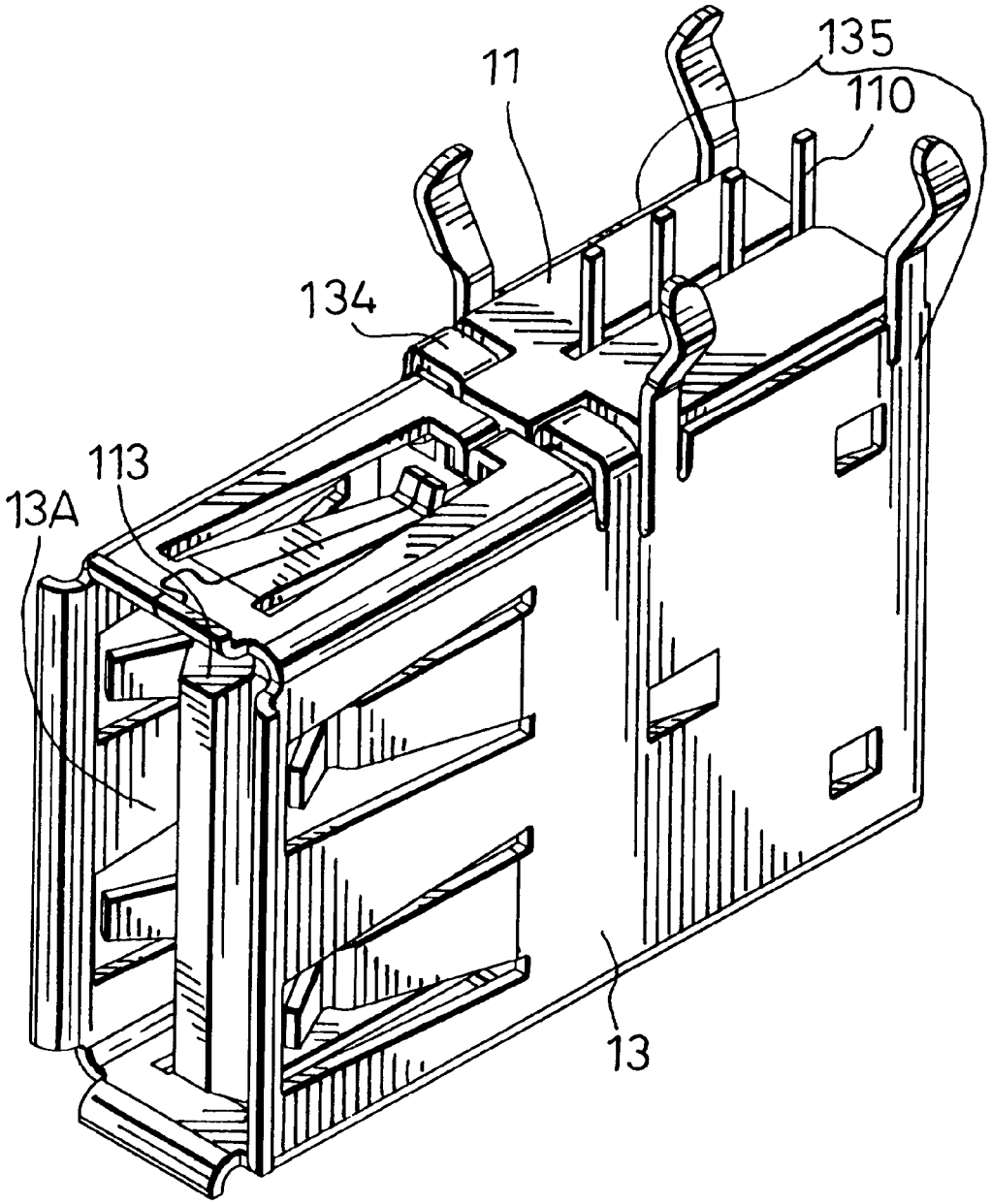
FIG. 2 is a perspective, inverted view of the conventional electrical receptacle connector shown in FIG. 1.
Figure 3:
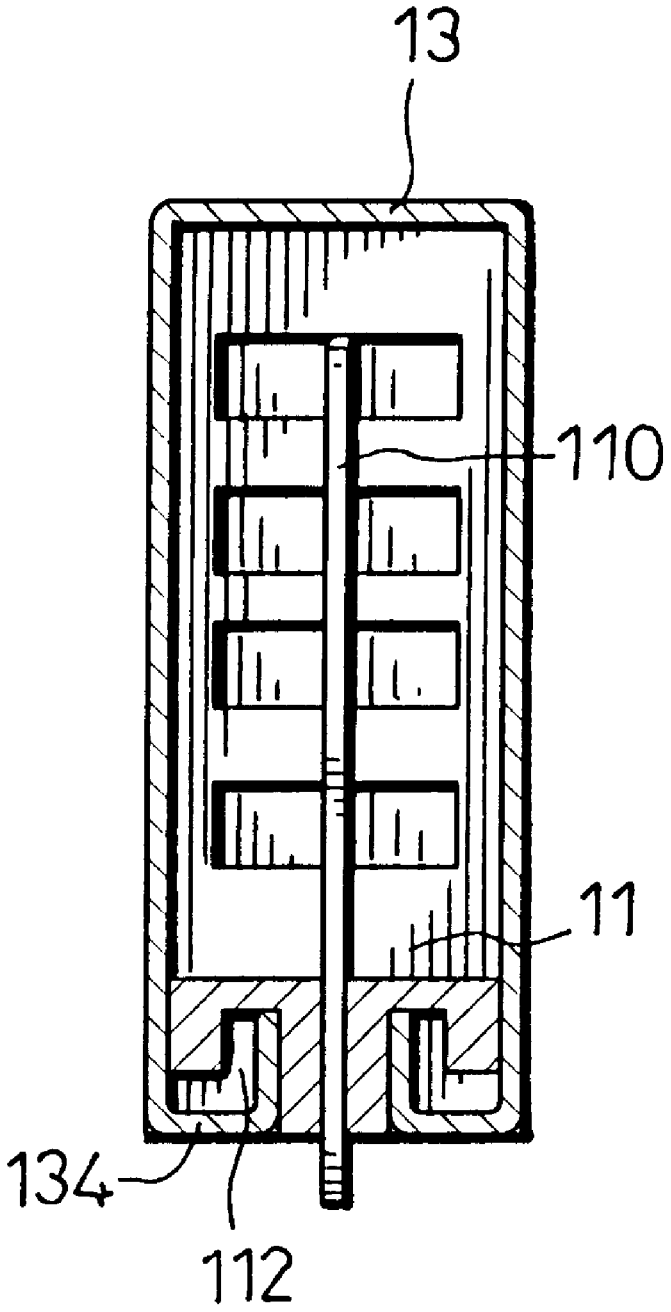
FIG. 3 PRIOR ART
FIG. 3 is a fragmentary and rear sectional view of the conventional electrical receptacle connector shown in FIG. 1.

Before the present invention is described in greater detail, it should be noted that like elements are denoted by the same reference numerals throughout the disclosure.

A preferred embodiment of the electrical surface-mount receptacle connector of a universal serial bus connector-type according to the present invention is adapted be mounted on a circuit board (not shown) and is adapted to mate with the shielded electrical plug connector (not shown).

Figure 4:
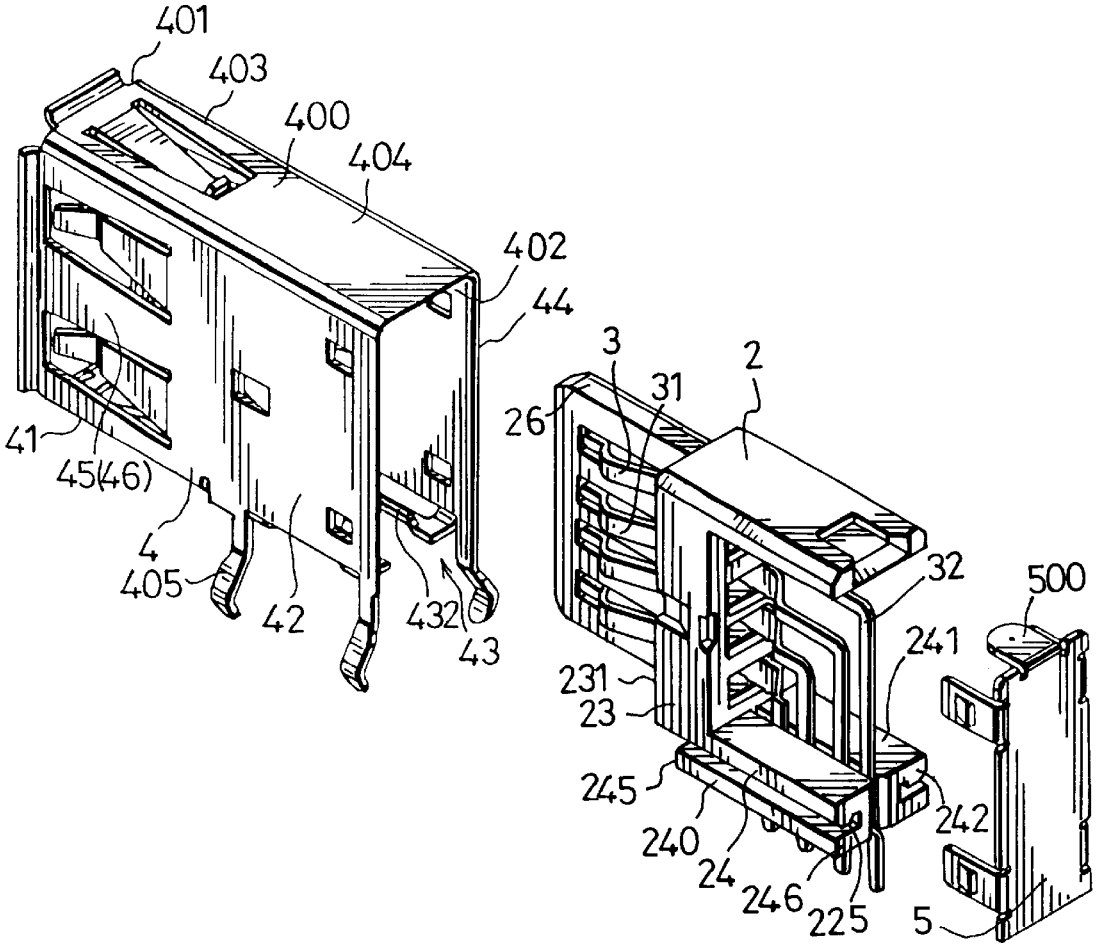
FIG. 4 is an exploded view of a preferred embodiment of the electrical surface-mount receptacle connector of a universal serial bus connector-type according to the present invention.
Figure 5:
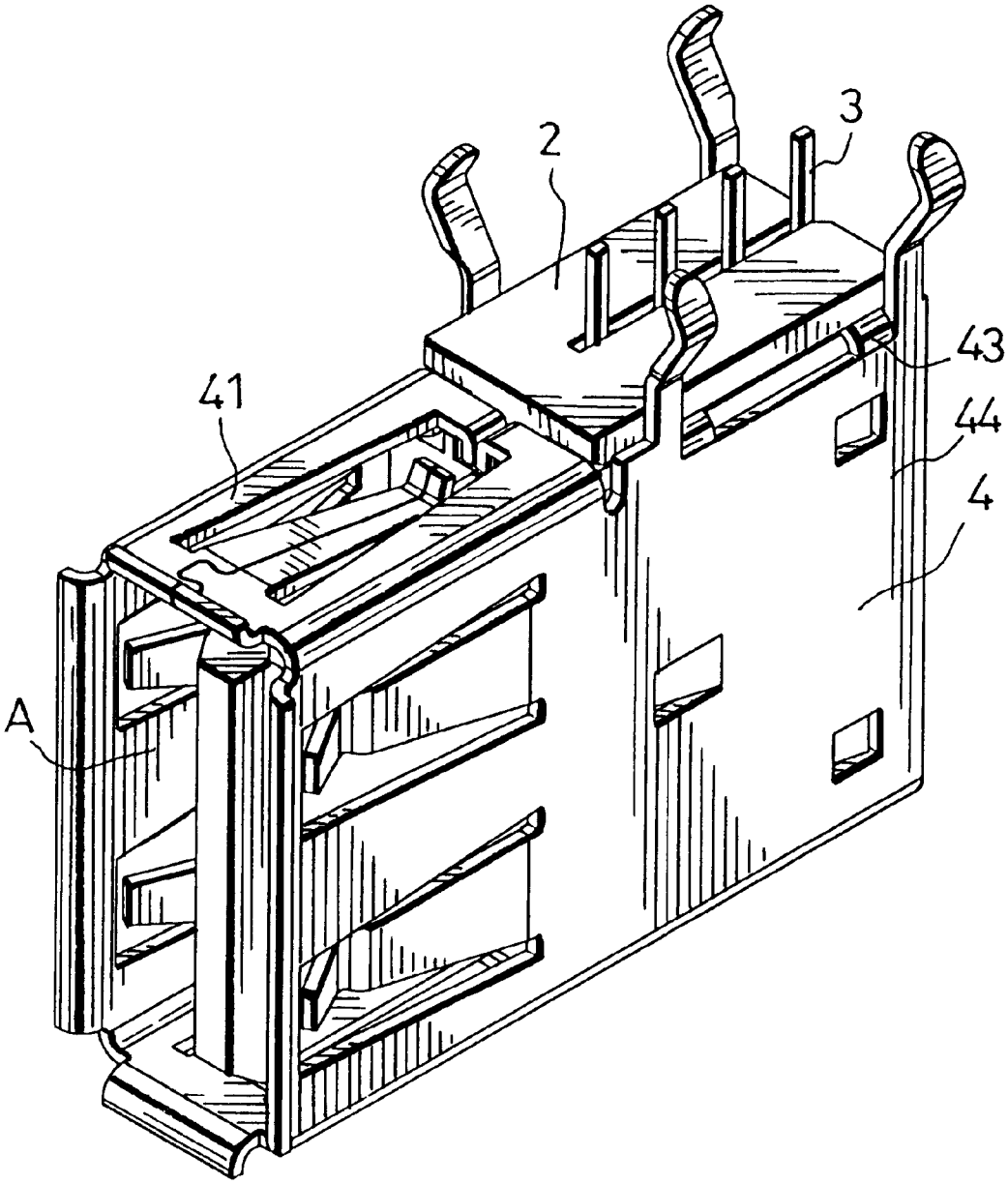
FIG. 5 is a perspective, inverted view of the electrical receptacle connector shown in FIG. 4.
Figure 6:
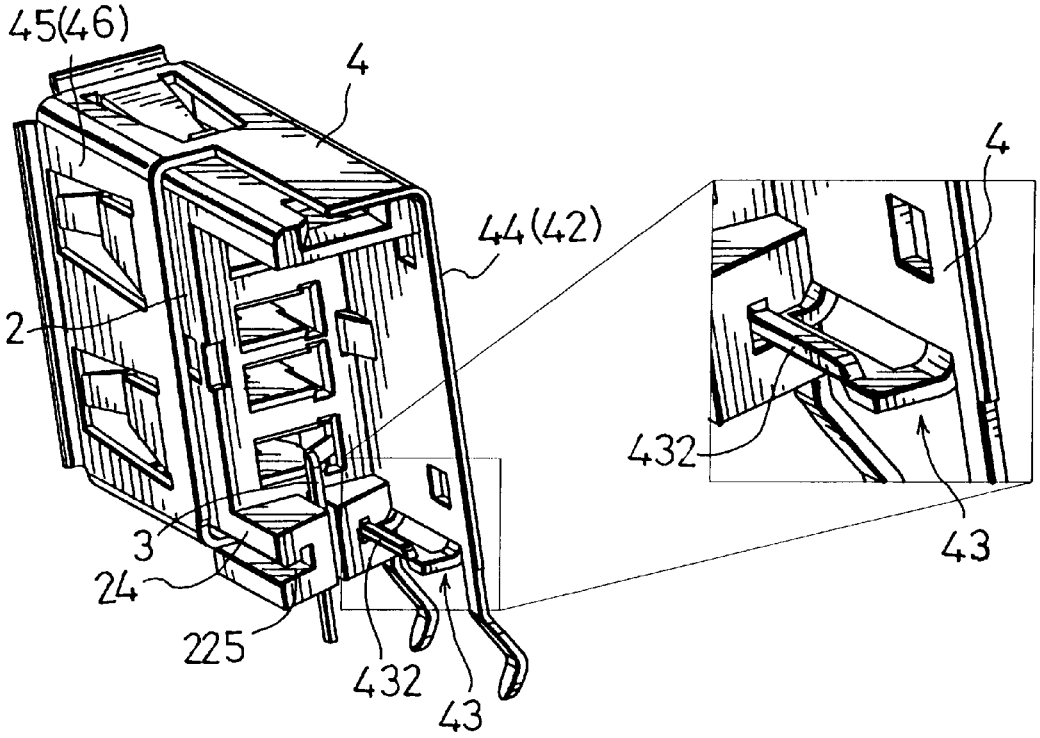
FIG. 6 is a partial cutaway view of the electrical receptacle connector shown in FIG. 4.

Referring to FIGS. 4 and 5, the preferred embodiment includes a plurality of contact terminals 3, a dielectric terminal mounting seat 2, a metal shield 4, and a metal cap 5.

As illustrated, each of the contact terminals 3 has a contact portion 31 that extends in a longitudinal direction, and a solder tail portion 32 that extends from the contact portion 32 in a first direction transverse to the longitudinal direction.

The dielectric terminal mounting seat 2 includes a mating portion 26 for mounting the contact portions 31 thereon and a terminal aligning portion 24 which has upper and lower major mounting surfaces 241,242 opposite to each other in the first transverse direction. The solder tail portions 32 of the contact terminals 3 pass through the upper and lower major mounting surfaces 241,242 and are adapted to be in electrical contact with the circuit board. The terminal aligning portion 24 further has a proximate end face 245 and a distal end face 246 relative to the mating portion 26 which are opposite to each other in the longitudinal direction, a pair of lateral walls 240 that extend between the proximate and distal end faces 245,246 and are opposite to each other in a second direction transverse to the first transverse direction, and a pair of tongue engaging groove units 225 formed in the lateral walls 240, respectively, and extending from the proximate end face 245 towards the distal end face 246 and crossing over at least one of the solder tail portions 32.

The metal shield 4 is disposed to shield the contact portions 31 and the solder tail portions 32 from electromagnetic interference in the first and second transverse directions. The metal shield 4 includes a hollow tubular shell 400 with first and second open ends 401,402 which are opposite to each other in the longitudinal direction. The tubular shell 400 includes a first tubular portion 403 that encloses and co-operates with the mating portion 26 to define an annular receiving space (A) therebetween (see FIG. 5) which is adapted to accommodate the shielded electrical plug connector when it is inserted thereinto via the first open end 401. A second tubular portion 404 extends integrally from and in alignment with the first tubular portion 403 to enclose the terminal aligning portion 4. The second tubular portion 404 has at least one pair of opposite side walls 42,44 that are spaced apart from each other in the second transverse direction and that extend in the first transverse direction to form a pair of spaced apart lowermost portions facing the lateral walls 240 of the terminal aligning portion 24 respectively, and at least two pairs of mounting legs 405 each pair being spaced apart from each other in the longitudinal direction by a bendable portion 43 with a length corresponding to a respective one of the tongue engaging groove units 225. The mounting legs 405 extend in the first transverse direction from the lowermost portions of the side walls 42,44. The mounting legs 405 are adapted to be inserted into the circuit board. The bendable portions 43 are punched and bent inwardly with respect to the side walls 42,44 to form a pair of engaging tongues 432 such that the engaging tongues 432 extend toward each other in the second transverse direction and engage the tongue engaging groove units 225 of the lateral walls 240, respectively, so as to prevent the lowermost portion of the side walls 42,44 of the second tubular portion 404 from being undesirably thrust away from the terminal aligning portion 24.

Each of the tongue engaging groove units 225 includes a groove of L-shaped cross section in the first transverse direction. Each of the L-shaped groove extends through the proximate and distal end faces 245,246. The engaging tongues 432 is configured to complement the L-shaped groove.

The terminal mounting seat 2 further includes a connecting portion 23 interposed between the mating portion 26 and the terminal aligning portion 24.

Figure 7:
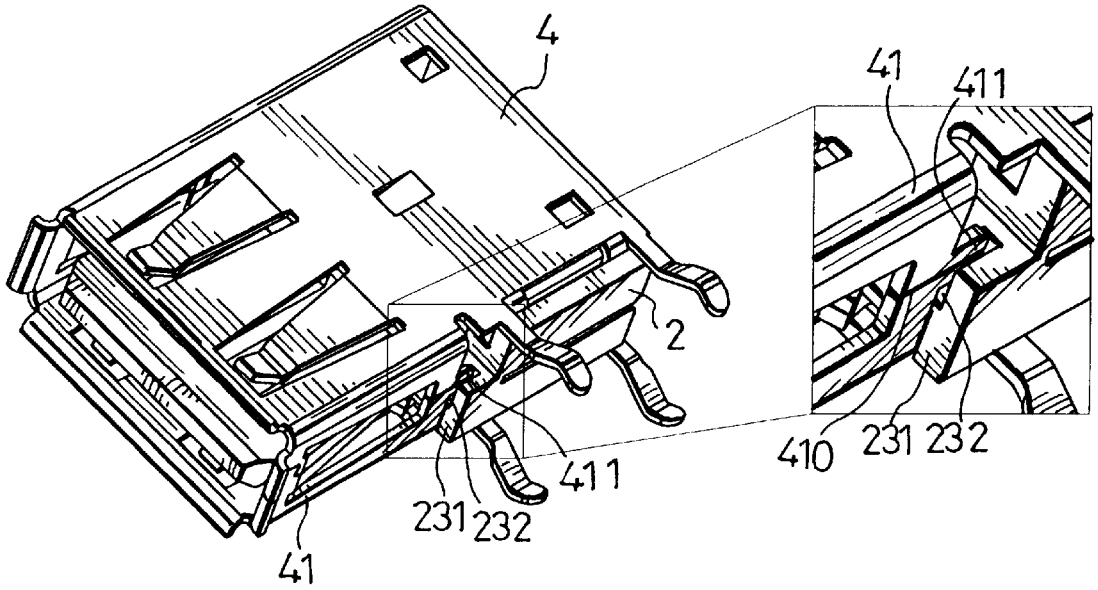
FIG. 7 is a perspective bottom view of the electrical receptacle connector shown in FIG. 4.

In the preferred embodiment, the first tubular portion 403 of the metal shield 4 includes left and right side walls 45,46 with a pair of lowermost sections and disposed on two sides of the mating portion 26, two bottom wall sections 41 between the left and right side walls 45,46 and that extend in the longitudinal direction and are formed by inwardly bending portions of the lowermost sections along two parallel lines extending in the longitudinal direction. The parallel lines are spaced from each other in the second transverse direction. A pair of engaging projections 411 (see FIG. 7) extend from the bottom wall sections 41 in the longitudinal direction toward the second open end 402 of the metal shield 2. The connecting portion 23 is formed with a mating surface 231 (see FIG. 7) which extends in the first direction. The mating portion 26 extends from the mating surface 231 opposite to the terminal aligning portion 24. The mating surface 231 of the connecting portion 23 is formed with a projection confining recess 232 to receive and confine the engaging projections 411 so as to prevent the engaging projections 411 from being thrust away from each other in the second transverse direction.

The metal cap 5 is disposed detachably on the second open end 402 of the metal shield 4 to shield the solder tail portions 32 from electromagnetic interference in the longitudinal direction. The metal cap 5 has a plurality of resilient tongues 500 engaging the engagement holes that are formed through the side walls 42,44 of the second tubular portion 404.

Figure 8:
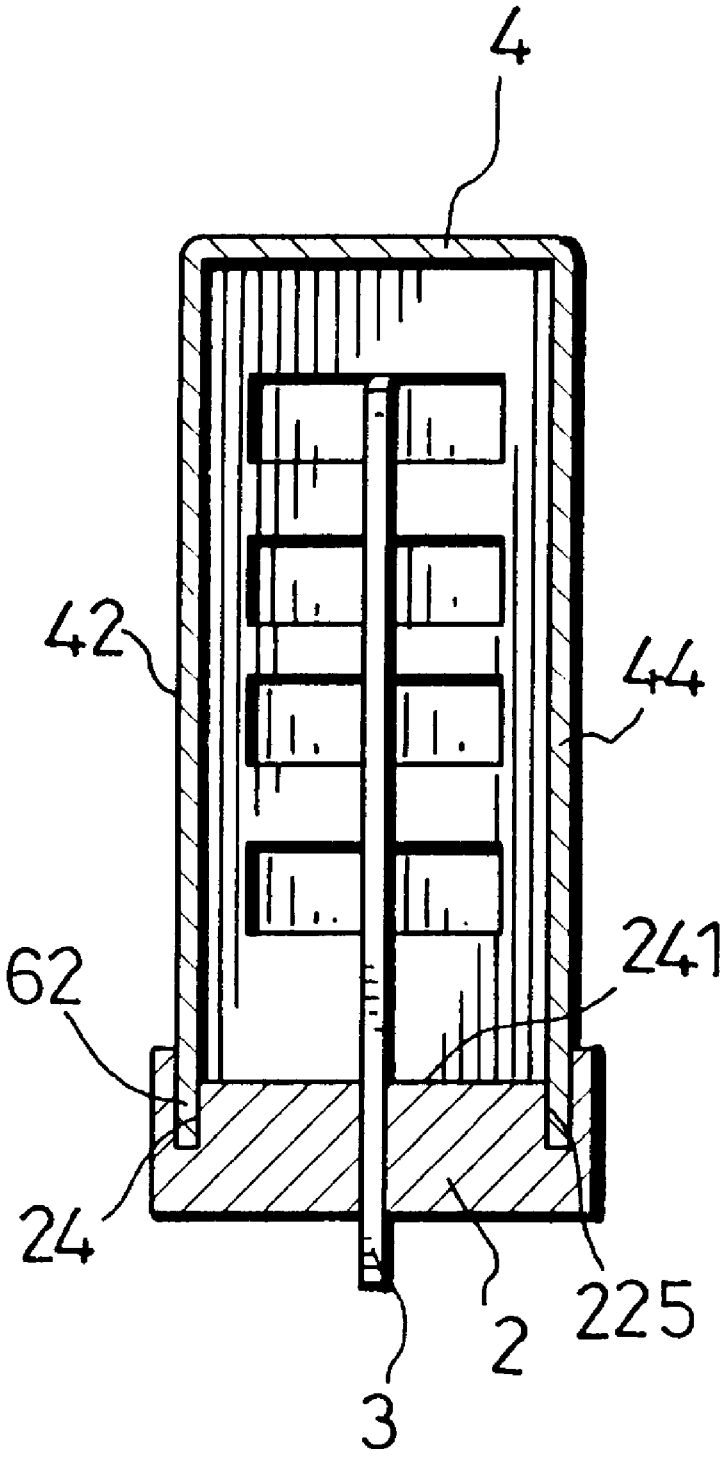
FIG. 8 is a rear view of a modified electrical receptacle connector of the present invention.

FIG. 8 shows a modified embodiment of the present invention which is similar to the previous embodiment in structure, except that the tongue engaging groove units 225 are formed on the upper major mounting surface 241 and are thus spaced apart from each other in the second transverse direction. The side walls 42,44 of the second portion in the metal shield 4 have a pair of insert portions 62 each of which is disposed between a pair of mounting legs (not shown). Each of the insert portions 62 has a length in the longitudinal direction and correspond to and extend into a respective one of the tongue engaging groove units 225 so as to prevent the lowermost portions of the side walls 42,44 from being thrust away relative to the terminal aligning portion 24.

With this invention thus explained, it is apparent that numerous modifications and variations can be made without departing from the scope and spirit of this invention. It is therefore intended that this invention be limited only as indicated in the appended claims.

What is claimed is:

1. A shielded surface-mount electrical receptacle connector adapted to be mounted on a circuit board and adapted to mate with a shielded electrical plug connector, the shielded surface-mount receptacle connector comprising:

a plurality of contact terminals, each having a contact portion extending in a longitudinal direction, and a solder tail portion extending from said contact portion in a first direction transverse to said longitudinal direction;

a dielectric terminal mounting seat including a mating portion for mounting said contact portions thereon and a terminal aligning portion which has upper and lower major mounting surfaces which are opposite to each other in said first transverse direction, said solder tail portions of said contact terminals passing through said upper and lower major mounting surfaces and adapted to be in electrical contact with the circuit board, said terminal aligning portion further having a proximate end face and a distal end face relative to said mating portion, a pair of lateral walls extending between said proximate and distal end faces and opposite to each other in a second direction transverse to said first transverse direction, and a pair of tongue engaging groove units formed in said lateral walls, respectively, and extending from said proximate end face towards said distal end face and crossing over at least one of said solder tail portions;

a metal shield disposed to shield said contact portions and said solder tail portions from electromagetic interference in said second transverse direction, said metal shield including a tubular shell with first and second open ends opposite to each other in said longitudinal direction, said tubular shell including a first tubular portion enclosing and cooperating with said mating portion to define an annular receiving space therebetween adapted to accommodate the shielded electrical plug connector when the latter is inserted thereinto via said first open end, and second tubular portion extending integrally from and in alignment with said first tubular portion and enclosing said terminal aligning portion, said second tubular portion having at least one pair of opposite side walls spaced apart from each other in said second transverse direction and extending in said first transverse direction to form a pair of spaced apart lowermost portions facing said lateral walls, respectively, at least two pairs of mounting legs each pair being spaced apart from each other in said longitudinal direction by a bendable portion with a length corresponding to a respective one of said tongue engaging groove units and extending in said first transverse direction from said lowermost portions of said side walls and adapted to be inserted into the circuit board, and a pair of engaging tongues each being formed by punching and bending said bendable portion of a respective one of said lowermost portions of said side walls such that said engaging tongues extend toward each other in said second transverse direction to engage said tongue engaging groove units of said lateral walls, respectively, so as to prevent said lowermost portions of said side walls of said second tubular portion from being undesirably thrust away from said terminal aligning portion.

2. The shielded surface-mount electrical receptacle connector as defined in claim 1, wherein each of said tongue engaging groove units includes a groove of an L-shaped cross section in said first transverse direction.

3. The shielded surface-mount electrical receptacle connector as defined in claim 2, wherein each of said engaging tongues is configured to complement said L-shaped groove.

4. The shielded surface-mount electrical receptacle connector as defined in claim 3, wherein each said L-shaped groove extends through said proximate and distal end faces.

5. The shielded surface-mount electrical receptacle connector as defined in claim 1, wherein said dielectric terminal mounting seat further includes a connecting portion interposed between said mating portion and said terminal aligning portion.

6. The shielded surface-mount electrical receptacle connector as defined in claim 5, wherein said first tubular portion of said metal shield includes left and right side walls with a pair of lowermost sections and disposed on two sides of said mating portion, two bottom wall sections between said left and right side walls and extending in the longitudinal direction and formed by bending portions of said lowermost sections along two parallel lines extending in said longitudinal direction and spaced from each other in said second transverse direction, and a pair of engaging projections respectively extending from said bottom wall sections in said longitudinal direction toward said second open end of said metal shield, said connecting portion being formed with a mating surface extending in said first direction, said mating portion extending from said mating surface opposite to said terminal aligning portion, said mating surface of said connecting portion further being formed with a projection retaining recess to receive and confine said engaging projections so as to prevent said engaging projections from being thrust away from each other in said second transverse direction.

7. The shielded electrical surface-mount receptacle connector as defined in claim 6, further comprising a metal cap disposed detachably on said second open end of said metal shield to shield said solder tail portion from electromagnetic interference in said longitudinal direction.

8. A shielded surface-mount electrical receptacle connector adapted to be mounted on a circuit board and adapted to mate with a shielded electrical plug connector, the shielded surface-mount receptacle connector comprising:

a plurality of contact terminals, each having a contact portion extending in a longitudinal direction, and a solder tail portion extending from said contact portion in a first direction transverse to said longitudinal direction;

a dielectric terminal mounting seat including a mating portion for mounting said contact portions thereon and a terminal aligning portion which has upper and lower major mounting surfaces opposite to each other in said first transverse direction, said solder tail portions of said contact terminals passing through said upper and lower major mounting surfaces and adapted to be in electrical contact with the circuit board, said terminal aligning portion further having a proximate end face and a distal end face relative to said mating portion, and a pair of tongue engaging groove units formed in said upper major mounting surface and extending between said proximate and distal end faces and spaced from each other in a second direction transverse to said first transverse direction and crossing over at least one of said solder tail portions;

a metal shield disposed to shield said contact portions and said solder tail portions from electromagetic interference in said second transverse direction, said metal shield including a tubular shell with first and second open ends which are opposite to each other in said longitudinal direction, said tubular shell including a first tubular portion enclosing and cooperating with said mating portion to define an annular receiving space therebetween adapted to accommodate the shielded electrical plug connector when the latter is inserted thereinto via said first open end, and second tubular portion extending integrally from and in alignment with said first tubular portion, said second tubular portion having at least one pair of opposite side walls spaced apart from each other in said second transverse direction and extending in said first transverse direction to form a pair of lowermost portions, at least two pairs of mounting legs each pair being spaced apart from each other in said longitudinal direction by an insert portion with a length corresponding to a respective one of said tongue engaging groove units and extending in said first transverse direction from said lowermost portions of said side walls to engage said tongue engaging groove units of said terminal aligning portion so as to prevent said lowermost portion of said side walls of said second tubular portion from being undesirably thrust away from said terminal aligning portion.

9. The shielded surface-mount electrical receptacle connector as defined in claim 8, wherein each of said tongue engaging groove units extends through said proximate and distal end faces.

* * * * *